US005251553A

United States Patent [19]

Bielfeldt

[11] Patent Number: 5,251,553

[45] Date of Patent: Oct. 12, 1993

[54] DEVICE FOR GUIDING STEEL BANDS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 969,055

[22] Filed: Oct. 30, 1992

Related U.S. Application Data

[62] Division of Ser. No. 672,668, Mar. 21, 1991, Pat. No. 5,182,986.

[30] Foreign Application Priority Data

Jun. 1, 1990 [DE] Fed. Rep. of Germany ..... 4017812

[51] Int. Cl.[5] ..... B30B 5/06

[52] U.S. Cl. ..... 100/151; 198/806; 425/371

[58] Field of Search ..... 100/93 P, 151-154; 162/272, 273; 198/626.4, 626.5, 626.6, 806, 807, 813-816, 861.6; 226/21; 425/150, 363, 371; 474/103, 110, 123

[56] References Cited

U.S. PATENT DOCUMENTS

| | | | |
|---|---|---|---|
| 218,030 | 7/1879 | Jaeger | 474/123 |
| 2,075,111 | 3/1937 | Gulliksen et al. | 474/103 X |
| 2,600,273 | 6/1952 | Seifried | 474/103 |
| 2,674,366 | 4/1954 | Kindseth et al. | 198/806 |
| 3,120,862 | 2/1964 | Burger | 100/154 |
| 4,527,686 | 7/1985 | Satoh | 474/123 X |
| 4,909,719 | 3/1990 | Bielfeldt | 100/93 P X |
| 4,959,040 | 9/1990 | Gardner et al. | 474/103 |
| 5,074,450 | 12/1991 | Lindner et al. | 226/21 |

FOREIGN PATENT DOCUMENTS

| | | | |
|---|---|---|---|
| 2316781 | 10/1974 | Fed. Rep. of Germany | 425/371 |
| 2643346 | 3/1978 | Fed. Rep. of Germany | 100/151 |
| 2812013 | 9/1979 | Fed. Rep. of Germany | 100/151 |
| 3149243 | 6/1983 | Fed. Rep. of Germany | 100/93 P |
| 4706 | 6/1896 | Netherlands | 474/123 |
| 861084 | 9/1981 | U.S.S.R. | 425/371 |

*Primary Examiner*—Stephen F. Gerrity
*Attorney, Agent, or Firm*—Foley & Lardner

[57] ABSTRACT

A method and apparatus are provided for guiding first and second bands of a continuously working press via driving drums and return drums around a pressing ram and a pressing table, respectively, while supporting the steel bands, with an adjustable pressing gap formed therebetween, on a plurality of co-rotating steel rods which are guided with their axes of rotation extending transversely to the direction of travel of the bands. A device is provided for realigning the first steel band with respect to a longitudinal center-line of the press and the pressing table. The realigning step includes the steps of relieving pressure in short-stroke pressure cylinders located in a high-pressure region of the press, and then horizontally rotating the pressing ram and those pressure rollers and pressure drums which are connected to the pressing ram through an angle $\alpha$ about a vertical axis of rotation which is located on the longitudinal center-line of the press.

9 Claims, 4 Drawing Sheets

DEVICE FOR GUIDING STEEL BANDS

This application is a division of application Ser. No. 07/672,668, filed Mar. 21, 1991 (now U.S. Pat. No. 5,182,986).

BACKGROUND OF THE INVENTION

1. Field of the Invention

The invention relates to a method and a device for guiding steel bands about the longitudinal axis of a continuously working press for the manufacture of particle boards, fiber boards, and plywood boards, which bands transmit the pressing pressure to the material to be pressed and draw the material through the press. More particularly, the invention relates to a method which can be performed on such a device in which the first and second bands are guided, via driving drums and return drums, around a pressing ram and a pressing table, respectively, with the steel bands being supported, with an adjustable pressing gap formed therebetween, on a plurality of co-rotating steel rods which are guided with their axes of rotation extending transversely to the direction of travel of said bands against abutments of the pressing table and pressing ram.

2. Discussion of Related Art

In continuously working presses of this type it is difficult, if not impossible, to align or position the longitudinal axis of the pressing ram and the pressing table so as to be congruent with one another due to the rigid construction of pressing table and pressing ram and the statically fixed arrangement of the pressing table and the pressing ram with respect to one another. An additional disadvantage which is apparent is that the steel bands also deviate from the longitudinal axis for this reason during operation and have to be readjusted.

The practical use of continuously working presses, whether they employ hydrostatic supports or rolling supports having rolling rods, has furthermore shown that with the provision of increasingly long presses in order to achieve greater outputs, it is no longer possible to ensure the necessary control of the steel bands. The limit is a press length of about 28 m. With increasing lengths of up to 40 m and more, slight disruptions occur, for example:

a) disruptions caused by lubricating the steel bands and rolling rods; and b) disruptions arising in the event of uneven bulk density distribution. These disruptions have a disruptive effect on an on-line control of the press. Consequently, it is not always possible to direct the steel bands back into the center by an angular adjustment of the driving drum axes and return drum axes in accordance with the prior art centering techniques. In the pressing-ram/-heated-plate region of the press, and in particular in the first one-third of the high-pressure zone, the steel bands are firmly clamped as in a vise. On adjusting the drum axes over the adjusting path, a somewhat greater elongation results in the intake region than in the clamped region, since the steel band is not clamped in the intake region. The same effect applies to the delivery end. The ratio of the clamped distance in the high-pressure region of the increasingly long presses to the unclamped part thus becomes more and more unfavorable as the press length increases. In order to avoid a one-sided overstretching of the steel bands on adjusting the course of the steel bands, the press must be stopped and all the attendant disadvantages endured.

OBJECTS AND SUMMARY OF THE INVENTION

The object on which the invention is based is to specify a method with which the longitudinal center axis of the pressing ram can be adjusted during operation so as to be congruent, i.e. exactly coincident with the longitudinal axis of the pressing table, with which one-sided overstretching of the steel band does not occur.

In accordance with a first aspect of the invention, the method comprises the steps of guiding the first and second bands, via driving drums and return drums, around a pressing ram and a pressing table, respectively, while supporting the steel bands, with an adjustable pressing gap formed therebetween, on a plurality of co-rotating steel rods which are guided with their axes of rotation extending transversely to the direction of travel of the bands, and realigning the first steel band with respect to a longitudinal center-line of the press and the pressing table. The realigning step includes the steps of relieving pressure in short-stroke pressure cylinders located in a high-pressure region of the press, and then horizontally rotating the pressing ram and those pressure rollers and pressure drums which are connected to the pressing ram through an angle $\alpha$ about a vertical axis of rotation which is located on the longitudinal center-line of the press.

In accordance with a further aspect of the invention, the realigning step further comprises the step of relieving pressure in short-stroke pressure cylinders located in a medium-pressure region of the press.

Another object of the invention is to provide a device for guiding first and second steel bands about a longitudinal axis of a continuously working press, the press including a pressing ram, a pressing table and a high-pressure region, and the bands transmitting pressing pressure to the material to be pressed and drawing the material through the press.

In accordance with one aspect of the invention, the device comprises driving drums and return drums which guide the first and second bands around the pressing ram and the pressing table, respectively and a plurality of co-rotating steel rods which are guided with their axes of rotation extending transversely to the direction of travel of the bands. The steel rods support the first and second steel bands with an adjustable pressing gap formed therebetween. Additionally provided are a fixed frame and stops which are connected to the frame and between which the pressing ram is rotatable about the vertical axis of the pressing ram through an angle $\alpha$. Tension-frame uprights support the press ram. Each of the uprights comprises a pair of parallel tension straps and parallel upper and lower crossheads connecting the tension straps to one another. The tension straps support the press ram and are pivotable together as legs of parallelograms through an angle $\beta$. In addition, four displacement cylinders are connected to respective corners of the pressing ram and drive the pressing ram to rotate about the vertical axis of the press, and short-stroke pressure cylinders, which are located in the high pressure region of the press and which apply a pressing pressure to the bands, are deactivated when the pressing ram is rotating.

With the solution in accordance with the invention, the pressing ram can be displaced as a whole about its central point in the manner of a parallelogram in such a way that an exact orthogonal alignment of the longitudinal center axes of pressing table and pressing ram is achieved during operation, it being possible to displace the pressing ram like a parallelogram by about 1° by means of rotating the freely movable tension straps in the region:

an angle $\alpha_1$ in the direction of an angle $\beta_1$ and an angle $\alpha_2$ in the direction of an angle $\beta_2$.

By this means, the pressing ram can be adjusted about the central point of the press to absorb the shearing forces between upper and lower steel bands, not only as a whole with respect to the pressing table by the angle $\alpha$ but also in the four corner points to reset the course of the steel bands. With regard to ensuring perfect control of the course of the steel bands, this repositioning can be effected manually or mechanically by means of hydraulic actuators. With the method according to the invention, the one-sided overstretching of the pressing ram steel band occurring in prior art positioning techniques is also avoided.

A further advantage which may be mentioned is that it expedites the maintenance or repair of a given section of the press. For example, if it is necessary to replace a length of about 4 to 5 m of the heated plate, the corresponding bundle of tension straps can be pivoted out laterally until free access to the corresponding press region is permitted.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Further features and advantages of the invention emerge from the following description of an exemplary embodiment with reference to the drawings, in which.

DETAILED DESCRIPTION OF THE PREFERRED EMBODIMENTS

Figure 1:
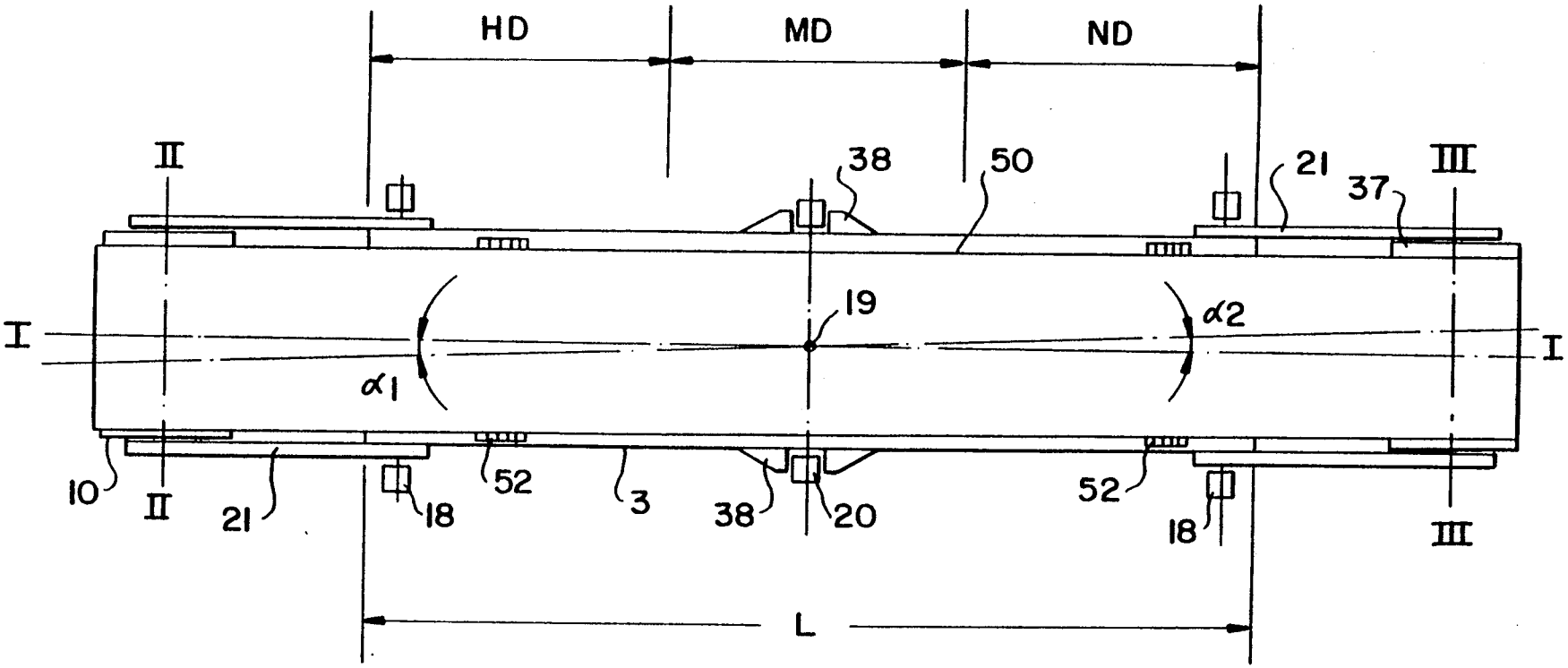
FIG. 1 shows a diagrammatic representation of the pressing ram with driving drums and return drums constructed in accordance with a preferred embodiment of the invention, in plan view.

As illustrated in FIGS. 1–4, a continuously working press 1 primarily consists of a fixed pressing table 2, a movable pressing ram 3, and tension-frame press uprights 36 arranged on the two longitudinal sides of the pressing table 2. Steel bands 50 are guided via driving drums 37 and return drums 10 over the pressing table 2 and pressing ram 3 and are supported on co-rotating rolling rods 52 with an adjustable pressing gap formed therebetween in the pressing region of the press. The rods 52 are guided with their axes extending transversely to the direction of travel of the bands 52 against abutments (not shown) of the pressing table and pressing ram. The pressing ram 3 and the pressing table 2 consist merely of web plates and transverse ribs connecting these web plates. A plurality of web plates having transverse ribs are welded together to form individual spars 8 which, by their arrangement next to one another and their attachment to the heated plates 14, form the length L of pressing ram 3 and pressing table 2 and thus of the heated-plate press. The lugs or projections protruding from the web plates on the left and on the right act as abutments for the tension frame press uprights 36 in order to lift and lower the pressing ram 3, with short-stroke pressing cylinder/piston arrangements being arranged between the upper crossheads 23 and the lugs of the pressing ram 3.

Each tension-frame press upright 36 consists of two tension straps 13, an upper crosshead 23 and the lower crosshead 22. Elements 26, protruding on the left and on the right, are attached to the upper and lower crossheads 23 and 22. To connect the crossheads 22 and 23, the tension straps 13 are suspended by their eyes 27 on the elements 26. The elements 26 may be either pivots connected to the tension straps or removable pins.

Figure 2:
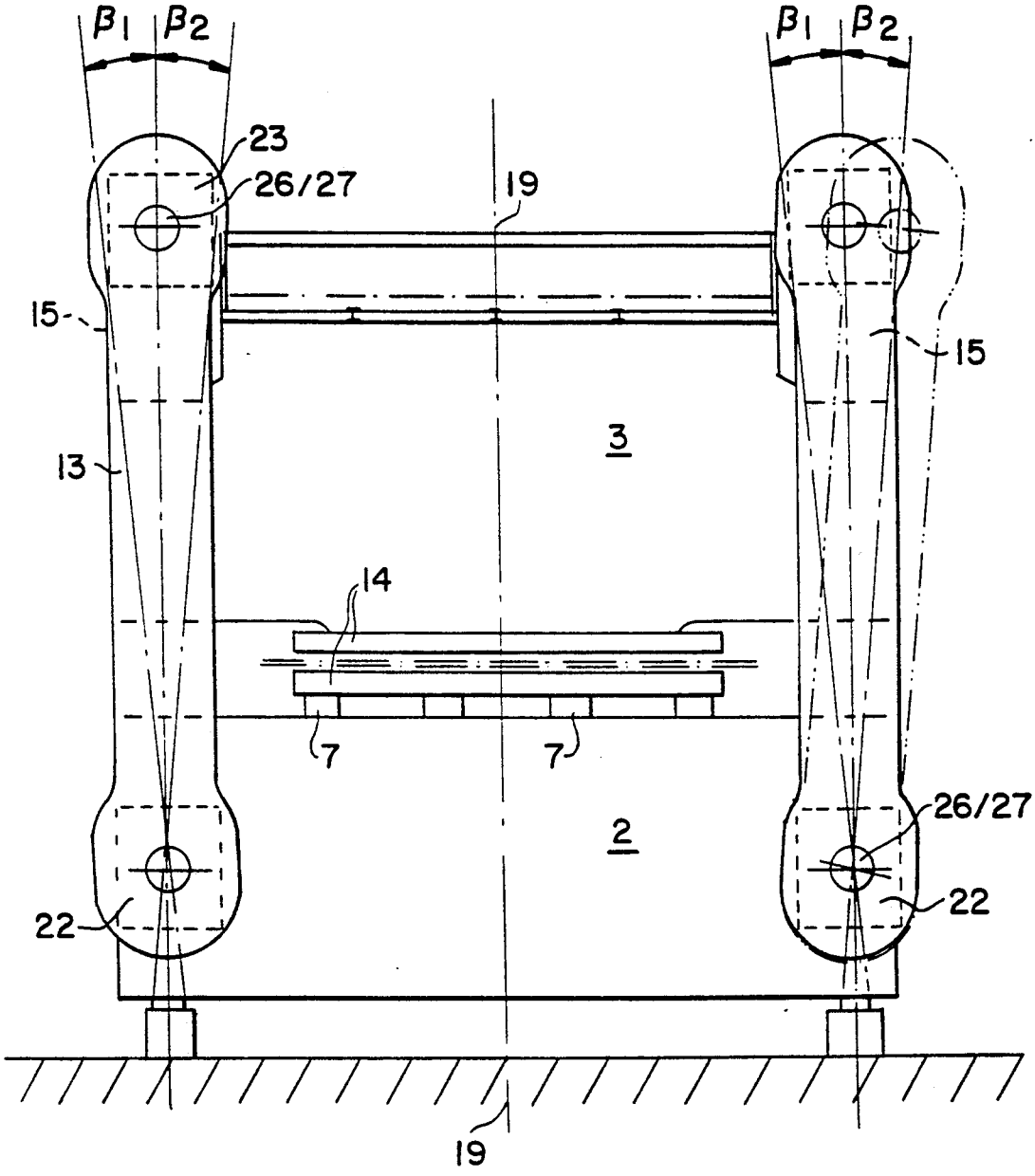
FIG. 2 shows a front view of the press according to the invention taken along a section A–B according to FIG. 4 without steel bands.
Figure 3:
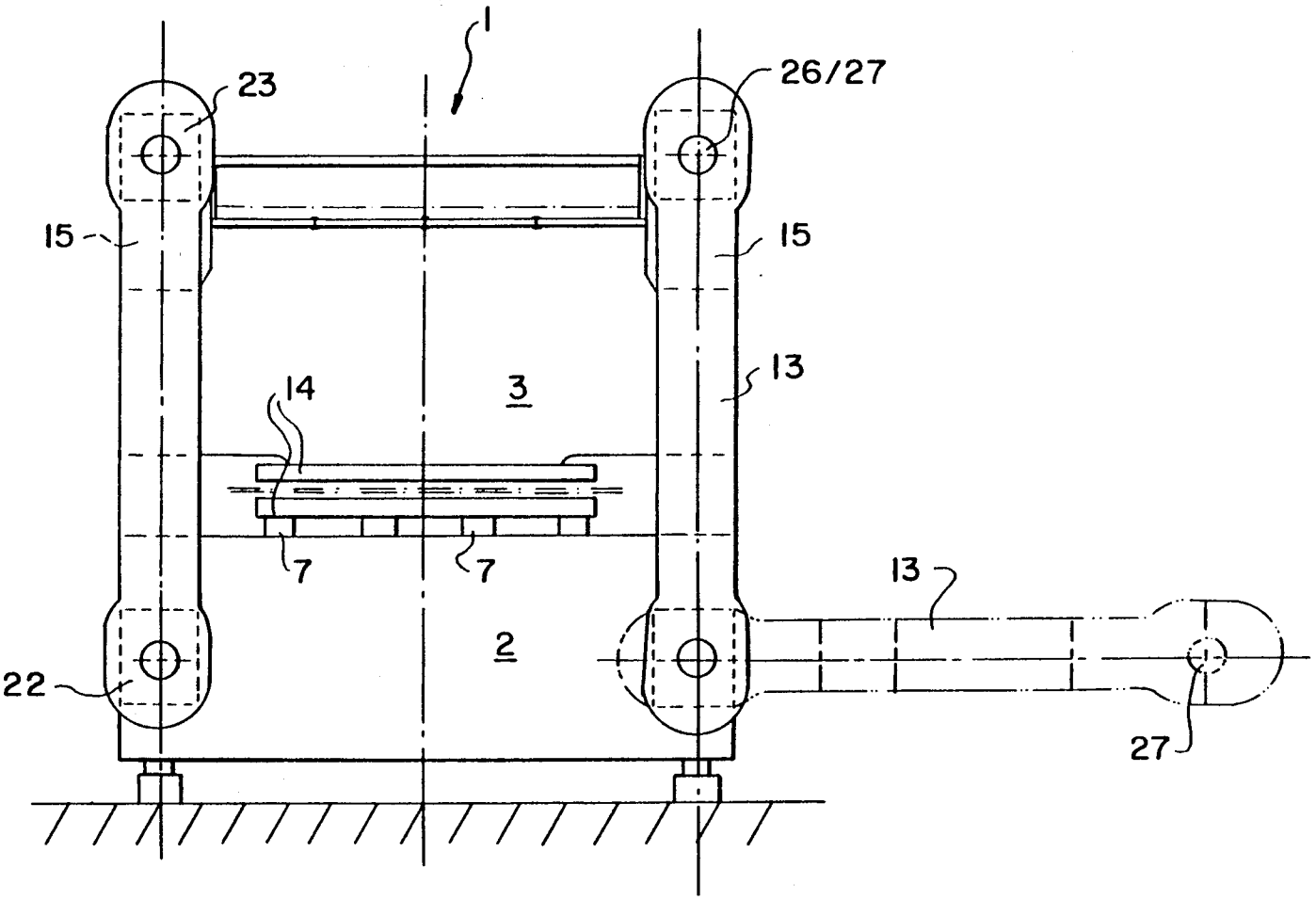
FIG. 3 shows the press according to FIG. 2 with pivoted-out tension straps.
Figure 4:
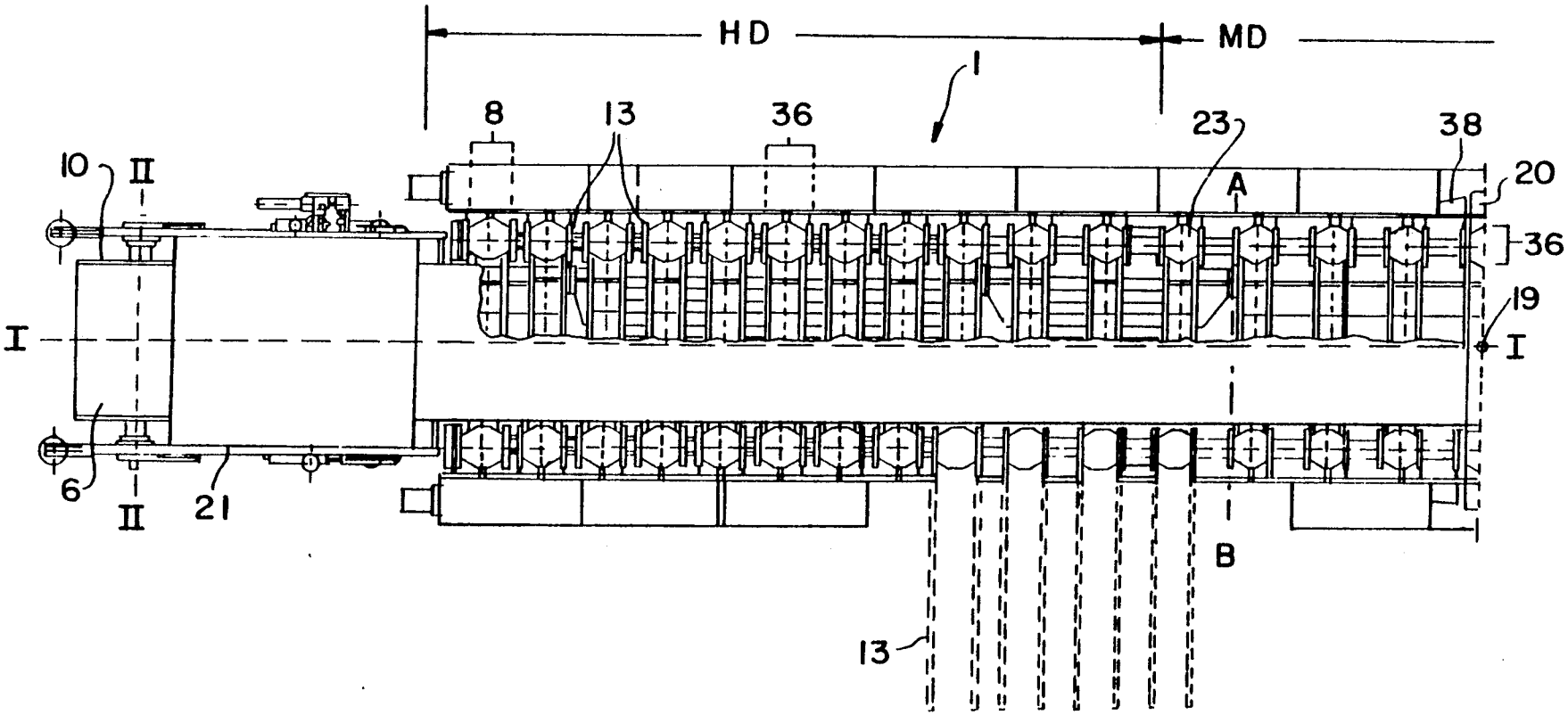
FIG. 4 shows a partial view of the press according to FIG. 3, in plan view.

As FIGS. 1 and 2 show furthermore, the pressing ram 3 is arranged displaceably or rotatably about the axis of rotation 19 and the longitudinal center axis I—I in the manner of a parallelogram by means of four displacing cylinders 18 arranged at the corners of the pressing ram. The rotation of the pressing ram 3 is limited in this case on a fixed-upright frame 20 by four stops 38. The realignment of the longitudinal center axis I—I of the pressing ram 3 by the angle $\alpha_1$ and $\alpha_2$ with the longitudinal center axis of the pressing table 2 is thus also followed by the tension-frame press uprights 36, having tension straps 13 which are attached to the press ram 3 and to the crossheads 22, 23 so as to be freely movable, by an angle $\beta_1$ or $\beta_2$. In addition to this parallelogram displacement of the pressing ram 3, however, it is also possible to reset a course of the pressing ram steel band 6 about the driving drum axes and return drum axes II—II and III—III. In this latter case, in particular, a movement conserving the steel band 6 due to the temporary relief from the pressing pressure in the high-pressure region HD and in the case of particularly high pressing pressure also in the medium-pressure region MD is effected. Pressure relief is performed by relieving pressure in the conventional short-stroke pressure cylinders 7, 15 which supply pressing force to plates 14. The pressure should be relieved at least from just before the pressure ram is rotated and should remain relieved during the entire rotation of the pressing ram 3. A relief of the low-pressure region ND is not absolutely necessary at the pressures currently used. In the present exemplary embodiment, the three regions HD, MD and ND are in each case one third of the press length L. The side plates 21 are firmly connected to the pressing ram and serve as an anchorage and bearing for the driving drum 37, for the return drum 10 and for the adjusting cylinders (not shown) arranged on the axes II—II and III—III of the two drums.

What is claimed is:

1. A device for guiding first and second steel bands about a longitudinal axis of a continuously working press, said press including a pressing ram having a vertical axis, a pressing table, and a high-pressure region, said bands transmitting pressing pressure to the material to be pressed and drawing said material through said press, said device comprising:

(A) driving drums and return drums which guide said first and second bands around said pressing ram and said pressing table, respectively;

(B) a plurality of co-rotating steel rods which are guided with their axis of rotation extending transversely to the direction of travel of said bands, said steel rods supporting said first and second steel bands with an adjustable pressing gap formed therebetween;

(C) a fixed frame;

(D) stops which are connected to said frame and between which said pressing ram is rotatable about said vertical axis of said pressing ram through an angle $\alpha$;

(E) tension-frame uprights which support said press ram, each of said uprights comprising a pair of parallel tension straps and parallel upper and lower crossheads connecting said tension straps to one another, said tension straps supporting said press ram and being pivotable together as legs of parallelograms through an angle $\beta$;

(F) four displacement cylinders which are connected to respective corners of said pressing ram and which drive said pressing ram to rotate about said vertical axis of said press; and (G) short-stroke pressure cylinders which are located in said high pressure region of said press and which apply a pressing pressure to said bands, said short-stroke pressure cylinders being deactivated when said pressing ram is rotating.

2. The device as claimed in claim 1, wherein each of said tension straps is pivotally connected to each of the respective upper and lower crossheads via one of pivots attached to said tension strap and removably pins, said tension straps being pivotable both upwardly and downwardly with respect to said crossheads.

3. The device as claimed in claim 1, wherein said press has a medium-pressure region, and further comprising short-stroke pressure cylinders which are located in said medium-pressure region and which apply pressing pressure to said steel bands, said short-stroke pressure cylinders in said medium-pressure region being deactivated when said pressing ram is rotating.

4. A device for guiding first and second steel bands about a longitudinal axis of a continuously working press, said press including a pressing ram having a vertical axis and a pressing table, said bands transmitting pressing pressure to the material to be pressed and drawing said material through said press, said device comprising:

(A) devices which guide said first and second bands around said pressing ram and said pressing table, respectively;

(B) a fixed frame;

(C) stops which are connected to said frame and between which said pressing ram is rotatable about said vertical axis of said pressing ram through an angle $\alpha$;

(D) tension-frame uprights which support said press ram, each of said uprights comprising a pair of parallel tension straps and parallel upper and lower crossheads connecting said tension straps to one another, said tension straps supporting said press ram and being pivotable together as legs of parallelograms through an angle $\beta$; and (E) means for driving said pressing ram to rotate about said vertical axis of said press.

5. The device as claimed in claim 4, wherein each of said tension straps is pivotally connected to each of the respective upper and lower crossheads via one of pivots attached to said tension strap and removably pins, said tension straps being pivotable both upwardly and downwardly with respect to said crossheads.

6. The device as claimed in claim 4, wherein said press has a high-pressure region, and further comprising short-stroke pressure cylinders which are located in said high-pressure region and which transmit pressing pressure to said material to be pressed through said steel bands, said short-stroke pressure cylinders being deactivated when said pressing ram is rotating.

7. The device as claimed in claim 6, wherein said press has a medium-pressure region, and further comprising short-stroke pressure cylinders which are located in said medium-pressure region and which transmit pressing pressure to said material to be pressed through said steel bands, said short-stroke pressure cylinders in said medium-pressure region being deactivated when said pressing ram is rotating.

8. The device as claimed in claim 4, wherein said means for driving comprises a plurality of displacement cylinders which are connected to said pressing ram.

9. The device as claimed in claim 8, wherein four of said displacement cylinders are connected to respective corners of said pressing ram.

* * * * *